United States Patent [19]

Hebert

[11] Patent Number: 4,653,595

[45] Date of Patent: Mar. 31, 1987

[54] METHOD AND APPARATUS FOR REMOTE RELEASE OF HAMMER AND FOLLOW BLOCK CHAIN CONNECTION

[75] Inventor: Francis A. Hebert, Schriever, La.

[73] Assignee: Soloco, Inc., Lafayette, La.

[21] Appl. No.: 770,200

[22] Filed: Aug. 28, 1985

[51] Int. Cl.[4] ..... B25D 7/06

[52] U.S. Cl. ..... 173/128; 173/89; 24/116 R; 24/573

[58] Field of Search ..... 173/81, 83, 84, 86, 173/88, 89, 90, 128–132; 294/75, 82.24, 82.35, 82.31; 24/116 R, 573; 405/255

[56] References Cited

U.S. PATENT DOCUMENTS

| | | | |
|---|---|---|---|
| 1,115,782 | 11/1914 | Christiani | 173/102 |
| 1,395,895 | 11/1921 | Bellony | 173/28 |
| 1,908,146 | 5/1933 | Helton | 294/75 |
| 2,423,301 | 7/1947 | Fairchild | 173/28 |
| 2,431,194 | 11/1947 | O'Brien | 294/75 |
| 2,668,732 | 2/1954 | Carlson | 294/75 |
| 2,904,347 | 9/1959 | Tucker | 24/116 R |
| 2,950,603 | 8/1960 | Macek et al. | 173/28 |
| 3,035,646 | 5/1962 | Johansson | 173/28 |
| 3,356,164 | 12/1967 | Mount | 173/102 |
| 3,431,011 | 3/1969 | Martin et al. | 294/75 |
| 3,450,274 | 6/1969 | Johansson | 173/86 |
| 3,482,639 | 12/1969 | Mixon | 173/28 |
| 3,490,548 | 1/1970 | Lake | 173/28 |
| 3,576,218 | 4/1971 | Lisenby | 173/28 |
| 4,439,056 | 3/1984 | Reilly et al. | 404/90 |

*Primary Examiner*—Donald R. Schran
*Assistant Examiner*—James L. Wolfe
*Attorney, Agent, or Firm*—Wilkinson, Mawhinney & Theibault

[57] ABSTRACT

The present disclosure is directed to a hammer and follow block chain remote release device and method to eliminate the need of a human having to ride the pile driving leads until the follow block is separated from the hammer. This is attained by passing a chain through the follow block and over horns on the hammer. A remote release device is connected to one end of the chain and an elongated link secured to the other end of the chain is engaged with the release device and a remotely actuated coupling member is pulled to release the connection between the chain and release device to permit separation of the follow block from the hammer by passage of the chain through the follow block and over the horns on the hammer.

6 Claims, 13 Drawing Figures

FIG. 4.
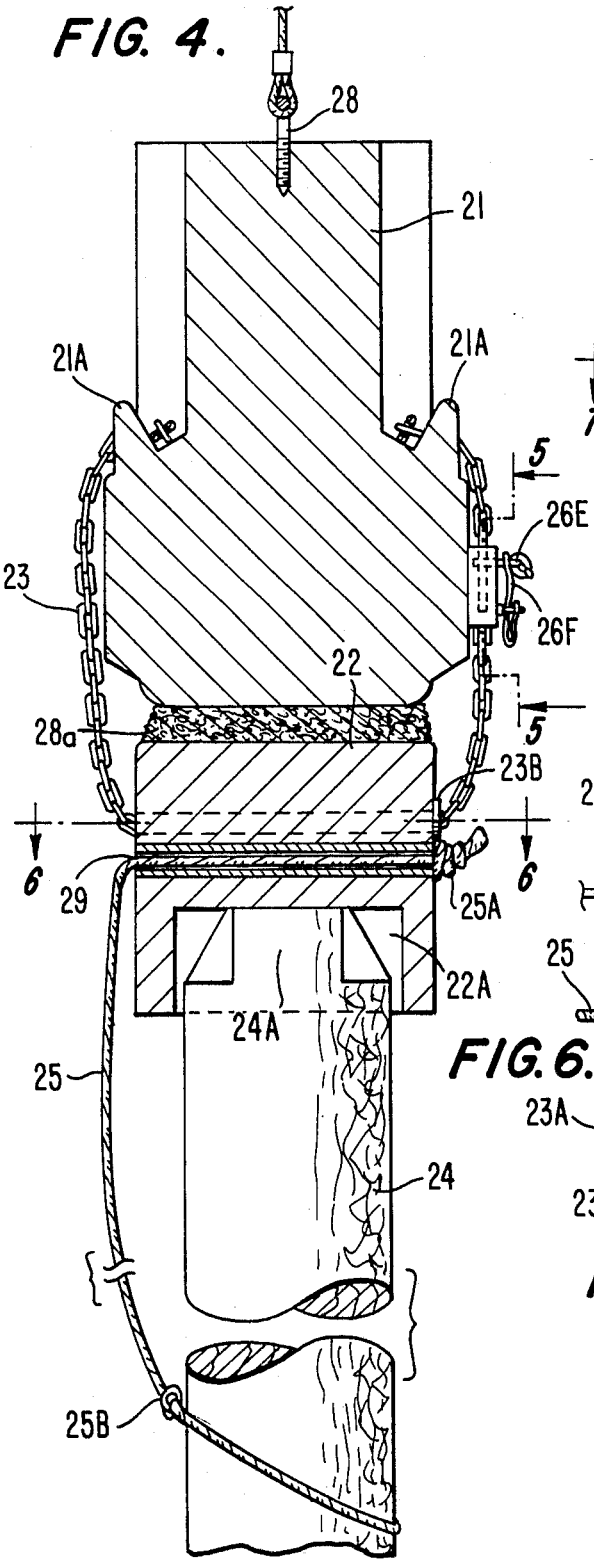
FIG. 5.
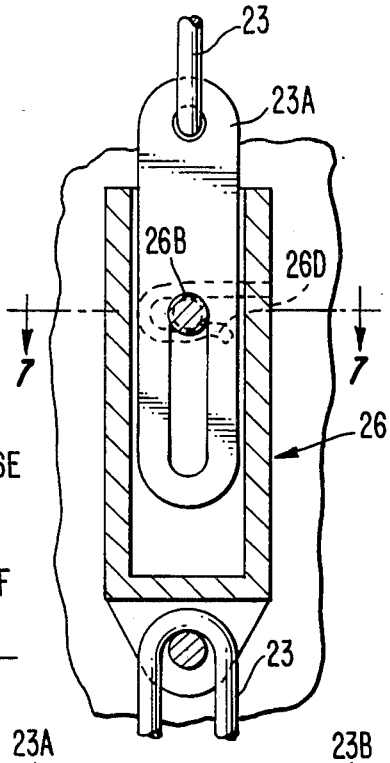
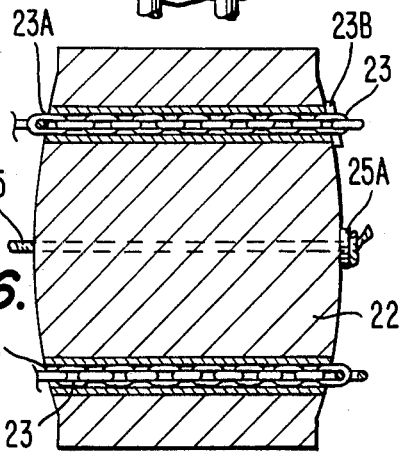
FIG. 6.
FIG. 7.
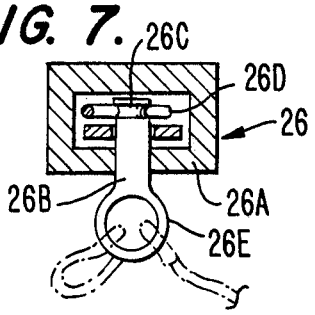

METHOD AND APPARATUS FOR REMOTE RELEASE OF HAMMER AND FOLLOW BLOCK CHAIN CONNECTION

BACKGROUND OF THE INVENTION

Heretofore in the pile driving art leads have been known which were raised and lowered by a dragline. Within the leads were a hammer and follow block. The follow block was connected to the hammer by a set of cables as shown in the W. W. Mount U.S. Pat. No. 3,356,164. The cable or chain art required a man to ride the leads which could subject him to extreme physical harm should the release of the follow block be untimely and the presence of a human riding the leads has resulted in numerous very expensive job related injury claims. The present invention relates to a method and apparatus which permits removal of the human from the leads when it is elevated. In accordance with the present invention, the connection between the hammer and follow block is made while the hammer is resting on the follow block and the leads is sitting on the ground prior to picking up a piling and placing it in the leads by raising the leads, hammer and chain connected follow back and the piling which is cable connected to the follow block and the chamfered end of the piling is within the hollow bore in the bottom of the follow block.

SUMMARY OF THE INVENTION

The present invention overcomes the hazards of the prior art by employing a new method of chain coupling the follow block to the hammer for a remote quick release of the chain coupling when the piling is initially seated in the earth and the hammer is resting upon the follow block with the chain coupling under a no load condition. This is the time to break the chain and remove its connection between the hammer and follow block. With the present invention this may be done remotely without requiring the presence of a human in the leads.

The invention contemplates two forms of mechanical devices either of which may be remotely triggered to accomplish chain separation freeing the follow block from the hammer leaving the hammer free to be raised and dropped upon the follow block to drive the piling into the earth.

A further object of the invention is to provide a rugged mechanical coupling device which will support the load of the follow block and pile without fortuitously separating and releasing the follow block and pile before they are in the position in which the pile is to be set and driven and which due to its simple rugged construction may be readily released remotely by a pull on a rope from a point well clear of the leads and follow block so that human contact with the leads is remote enough to assure personal safety of the person breaking the chain connection between the hammer and follow block.

BRIEF DESCRIPTION OF THE DRAWINGS

FIG. 4 is a vertical sectional view taken through the hammer, follow block and pile taken on the lines 4—4 in FIG. 3 showing the chain and cable connections.

FIG. 5 is an enlarged sectional view taken on the lines 5—5 in FIG. 4 of one form of remote actuated hammer and follow block release device constructed in accordance with the present invention.

FIG. 6 is a horizontal sectional view of the follow block shown in FIG. 4.

FIG. 7 is a horizontal sectional view of the chain release device taken on the lines 7—7 in FIG. 5.

THE BEST MODE FOR CARRYING OUT THE INVENTION

THE METHOD

Figure 1:
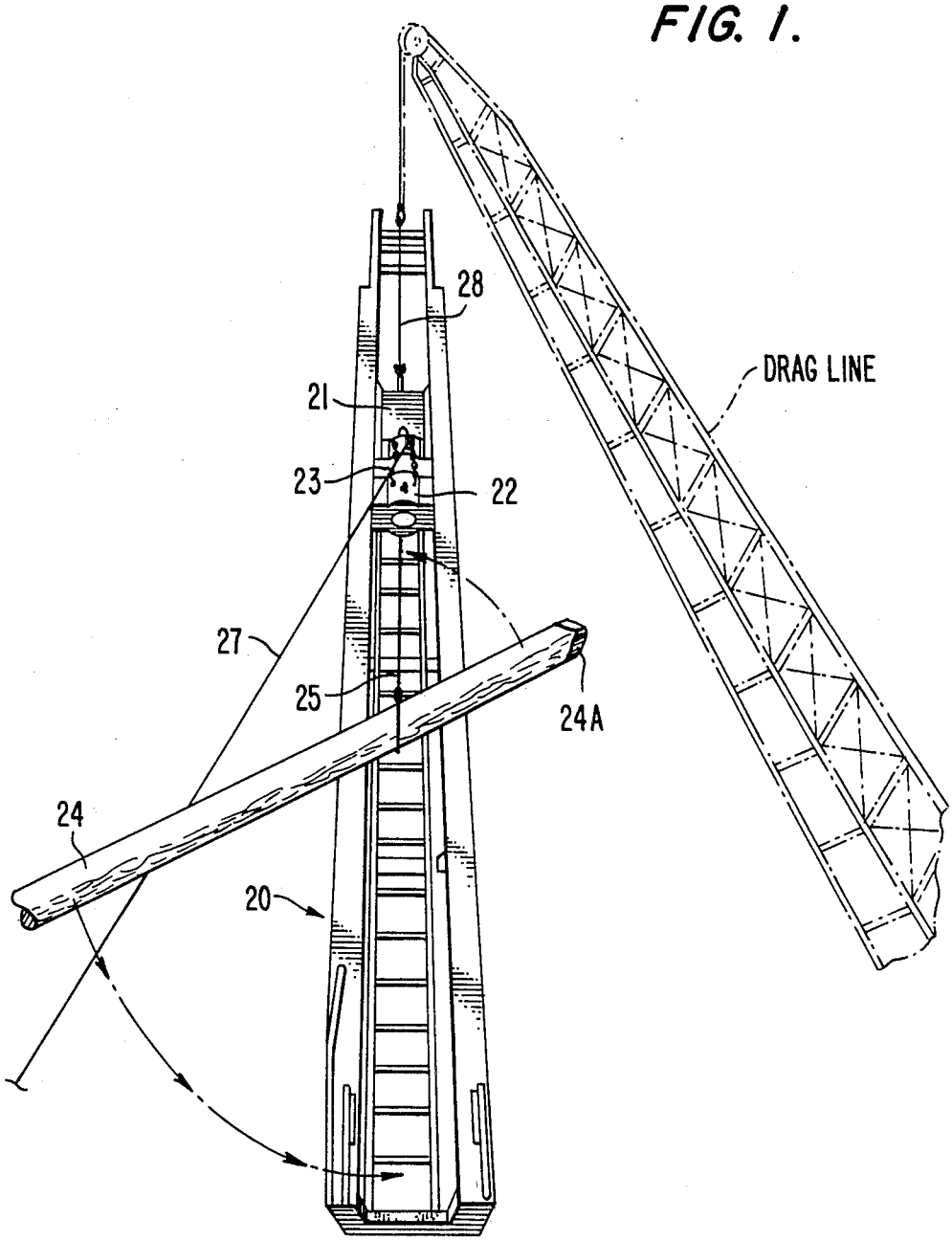
FIG. 1 is a schematic perspective view of a pile driving leads carried by a dragline having the hammer and follow block remote release coupling device of the present invention shown in the step of raising a piling for introduction to the leads preparatory to driving the piling.

The method of the present invention is directed to driving piles with a dragline manipulated leads structure 20 as best seen in FIG. 1. The problem outstanding in the art is that of being able to remotely separate a hammer 21 from a follow block 22 in the leads structure 20 without requiring a human to ride the leads and break the chain connection 23 between the hammer 21 and follow block 22. Having a human riding a leads with a two ton hammer periodically rising and falling can be and has been the cause of very serious accidents to workers.

Referring now to FIG. 1, the first step of the method is to establish the chain lifting connection 23 between the hammer 21 and follow block 22.

Figure 2:
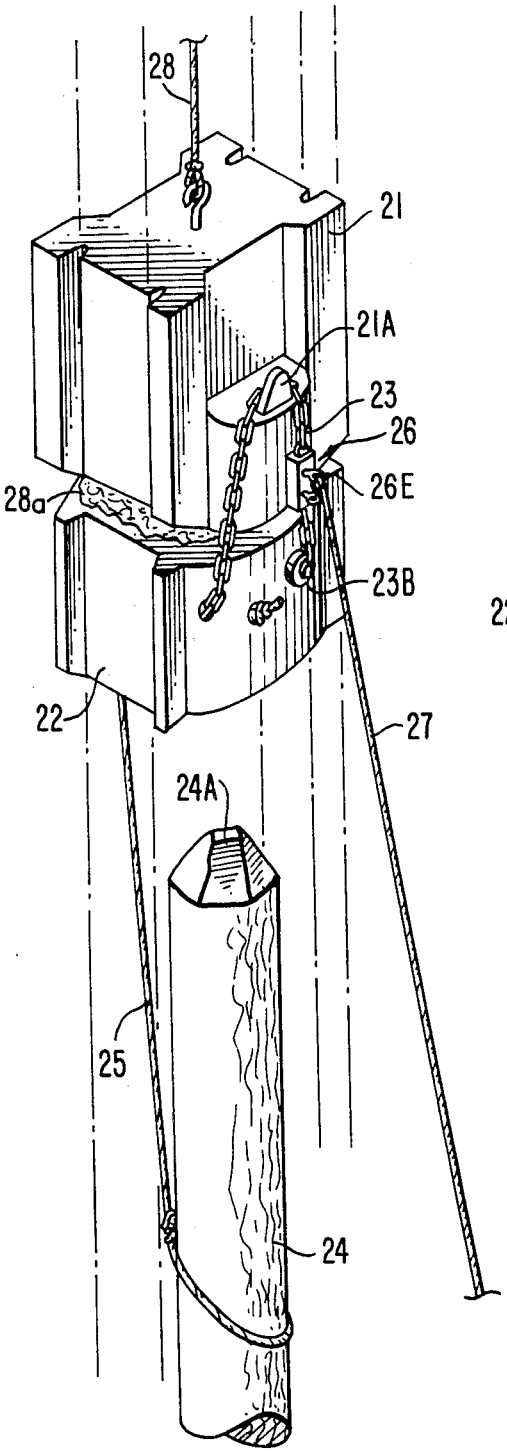
FIG. 2 is an enlarged schematic perspective view of the hammer and its chain coupled follow block with the piling entrained by a cable connection with the follow block.

The pile raising connection between the follow block 22 and pile 24 is a cable 25 one end of which is secured to the follow block 22 and the other end has a hook which is connected to the cable after it is passed about the pile 24 prior to its placement in the leads 20 as shown in FIGS. 1 and 2.

The chain release connection device 26 may be a remotely releasable one of the types shown in FIGS. 2 and 10 which may be remotely actuated by a pull rope 27 pulled by a person standing some distance from and well clear of the leads structure 20.

Figure 3:
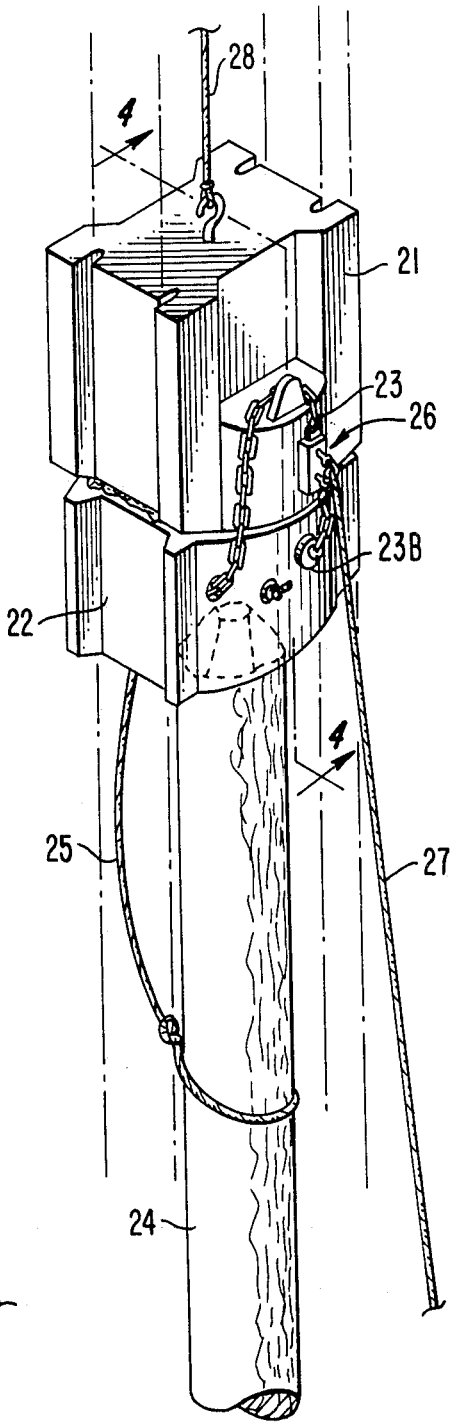
FIG. 3 is a view similar to FIG. 2 with the piling seated and the follow block resting upon the cap of the pile and the weight load of the follow block and pile being removed from the chain prior to remotely breaking the chain connection.
Figure 8:
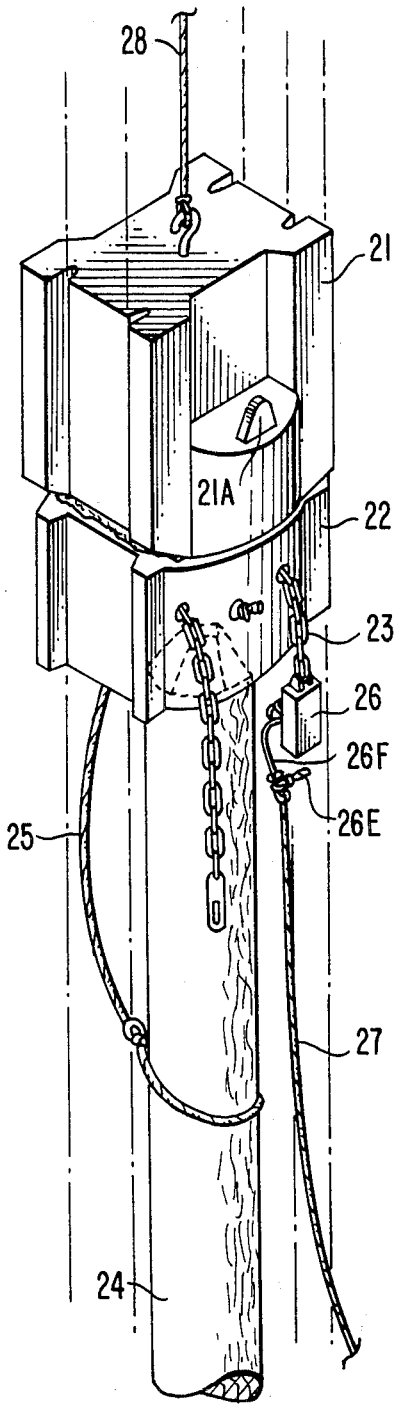
FIG. 8 is a schematic perspective view of the hammer, follow block and pile similar to FIG. 3 but with the chain release device actuated and the hammer free of the follow block for pile driving operation.
Figure 9:
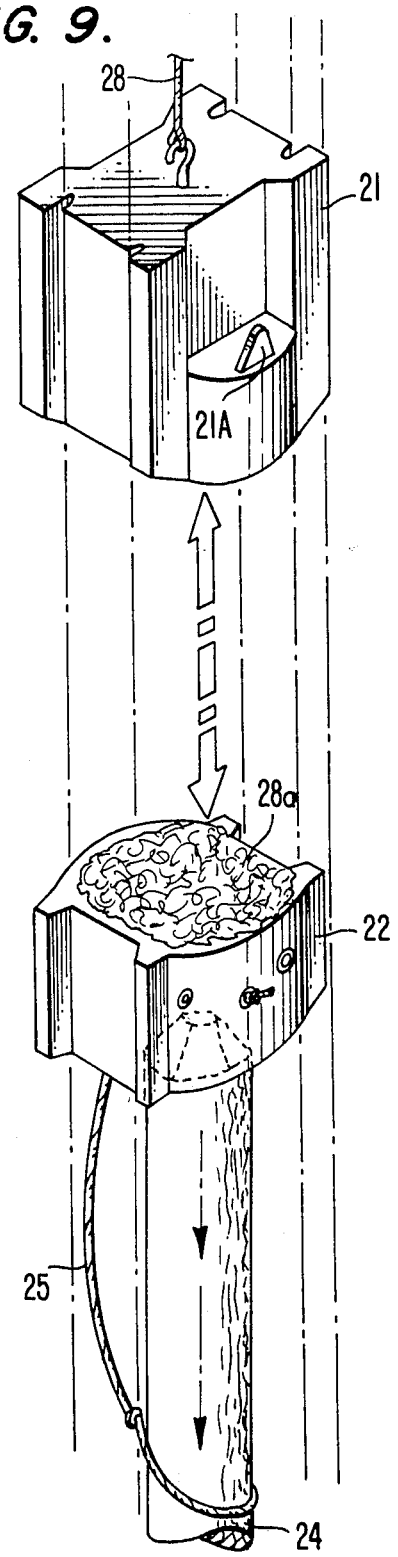
FIG. 9 is a schematic perspective view similar to FIG. 8 with the hammer in pile driving operation as indicated by the arrow.

The leads 20 is then lowered until the piling enters the earth and the piling 24 is then supporting the follow block 22 and hammer 21 and the hammer and leads weight is off the chain 23, as shown in FIG. 3. Then the chain release connection 26 is activated at an elevation of from 30 to 40 feet by pulling on rope 27 from the ground which releases the chain 23 breaking the chain connection between the hammer 21 and follow block 22, as shown in FIG. 8, so that upon raising the hammer 21 in the leads 20 with the dragline the chain will pay out through the follow block 22 and over horns 21A on hammer 21 to permit the follow block 22 to ride the piling 24 and the hammer 21 to be raised and dropped within the leads independently of the follow block 22 as shown in FIG. 9.

Figure 10:
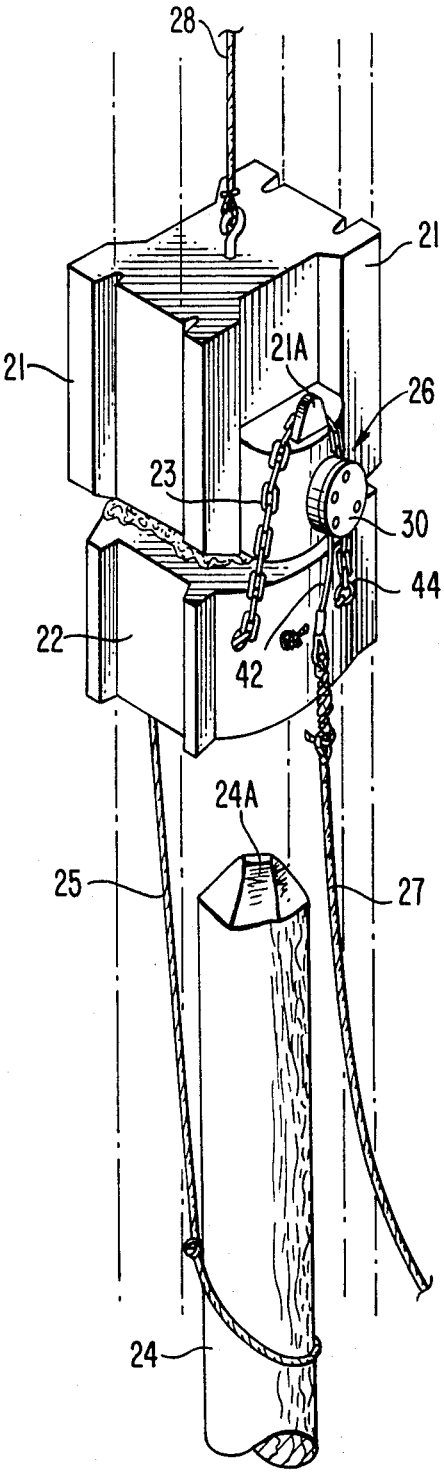
FIG. 10 is a schematic perspective view of the hammer, follow clock and pile similar to FIG. 2 with another form of remote actuated chain release device constructed in accordance with the present invention.
Figure 11:
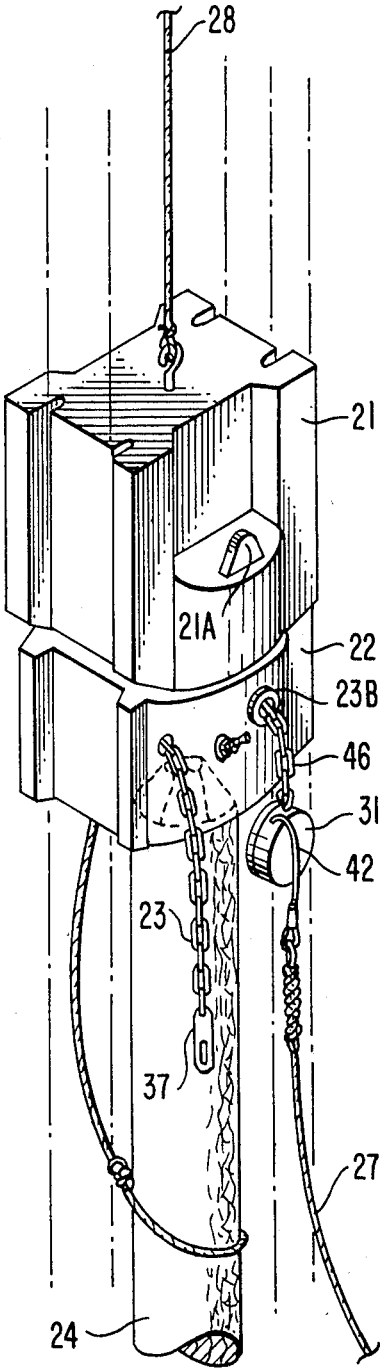
FIG. 11 is a view similar to FIG. 10 with the chain release device, shown in FIG. 10 actuated and the chain connection between the hammer and follow block broken.
Figure 12A:
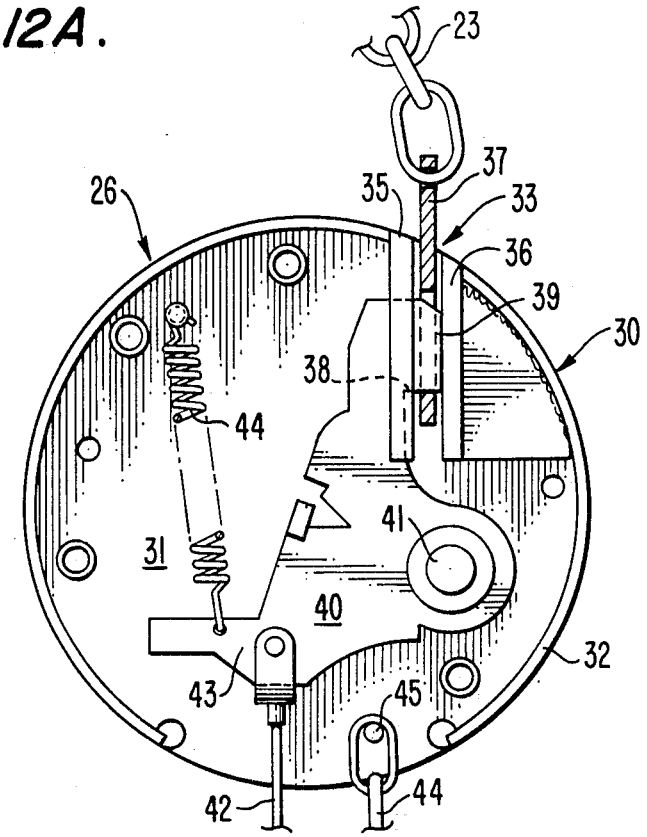
FIG. 12A is a vertical sectional view through the form of remotely actuated chain release device shown in FIGS. 10 and 11, in the chain engaged condition.
Figure 12B:
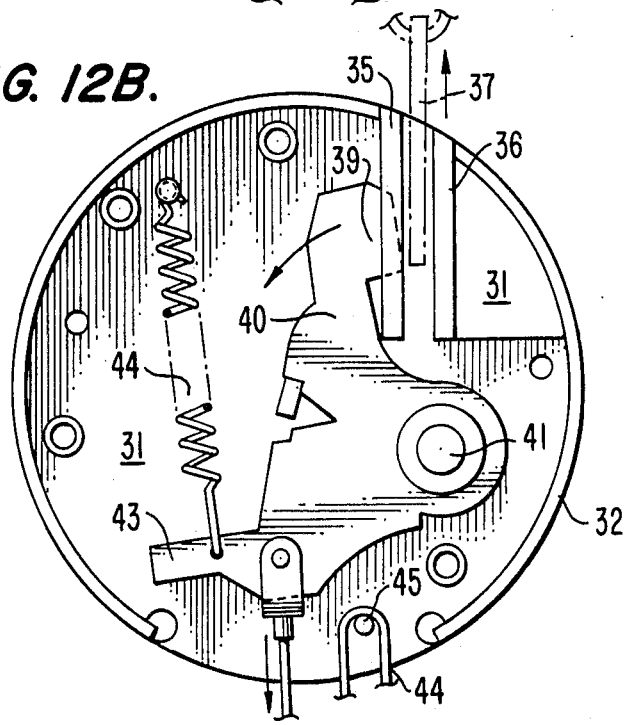
FIG. 12B is a view similar to FIG. 12A with the device in the chain released condition and the release rope pulled.

When the piling is driven to the selected height the hammer 22 is brought to rest on top of the follow block 22, the chain connection is re-established between the hammer and follow block as shown in either FIGS. 2 or 10, the cable 25 is then passed about another pile 24 and the process repeated.

THE APPARATUS

Referring now to FIGS. 1 and 2 through 8, the pile driving leads 20 has mounted therein for reciprocating movement a hammer 21 and a follow block 22. The hammer 21 has a cable connection 28 connected thereto at one end and is connected to a dragline pile driving connection for raising and dropping the hammer to drive the pile and another connection to raise and lower the leads. The hammer 21 also has horns 21A, one on each side as best seen in FIG. 4.

Positioned to be struck by the hammer 21 is a follow block 22 having a pile receiving bore 22A in its bottom which receives the chamfered end 24A of the piling to be driven. A pile attaching cable 25 is attached to the follow block 22 through opening or bore 29 being knotted at one side of the block 22 at 25A and having a hook 25B at the other end for hooking upon itself after being passed about the pile for raising the pile 24.

There is a chain connection 23 between the hammer 21 and the follow block 22 which is passed through bores in the block 22 and looped over the horns 21A on the hammer 21, see FIGS. 2 and 4.

One end of the chain 23 is attached to the bottom of the chain release device 26 and the other end of the chain 23 has an elongated link 23A which is received in the open end of a four walled chain quick release connection device 26. Below the device 26 and connected to the chain 23 is a chain stop 23B to stop the chain from being pulled through the bore shown in FIGS. 2, 3 and 4.

As shown in FIG. 7, the device 26 receives through one of its walls 26A a quick release pin 26B which has a groove 26C which engages a clip 26D to guard against the pin 26B being fortuitiously released at an inappropriate time. The pin 26B has an attaching eye 26E, as shown in FIG. 7, to which is attached the remote release pull cord 27 and a keeper rope 26F is attached to an eye on the wall 26A, as best seen in FIG. 8.

A suitable sound deadening material in the form of a mat or stack of plywood 28 rides the top of the follow block 22 and acts to absorb wear and noise when the block 22 is struck by the hammer 21.

After the piling 24 has been driven to the desired level and with the hammer 21 resting upon the block 22 the chain connection is re-established as shown in FIG. 3 by re-roving the chain 23 over the horns 21A, placing the elongaged link 23A back in the device 26 and reinserting the pin 26B through the opening in the wall 26B which passes through the elongated slotted link 23A and the hammer and follow block are once again ready to be raised after the cable 25 is passed about the next piling to be driven.

Referring now to FIGS. 10, 11, 12A and 12B a further form of remote actuated chain release device 26 is shown in which the chain release device 26 comprises a circular housing 30 having a front and back plate 30, 31 and a wall 32 in which there is an opening 33 having a slot 34 defined by plates 35, 36 into which is received a chain connected elongated link 37. Plate 35 has a slotted opening 38 to permit passage therethrough of a retainer projection 39 on a latch 40 which is pivoted at 41 to rock between the locked position of FIG. 12A and the link released position of FIG. 12B. A pull cable 42 is attached to an arm 43 on latch 40 to one side of the pivot 41. A bias spring 44 is connected at one end to plate 31 and to arm 43 at the other end. A chain connector length 44 is connected to the housing 30 at 45 and to the main chain 23 at 46. The remote actuating rope 27 is connected to the short pull rope 27 to effect release of the chain 23 to separate the hammer 21 from the follow block 22 causing the chain release device 26 to fall from the position of FIG. 10 to that of FIG. 11, wherein the elongated link 37 and chain 23 passes over the horns 21A of the hammer 21, through the openings through block 22 breaking the chain connection between the hammer 21 and follow block 22 so that the pile driving operation of FIG. 9 may be carried out.

What I claim is:

1. For use with a pile driving leads having a dragline raising and dropping connection, a hammer and follower block assembly comprising a hammer, horns extending off the front and rear face of said hammer proximate the mid-point between the top and bottom of said hammer and being canted outwardly of said hammer, means at the top of said hammer for attachment to said dragline raising and dropping connection, a follower block having two chain bore openings horizontally therethrough one at each side of the centerline of said block, a vertical bore in the bottom of said follower block for receiving the cap end of a pile to be driven, a pile pick up line passing through said block between said chain bore openings and being secured to one side of said block against pull through and having a pile attaching loop at its other end, a chain having an elongated link having an opening therethrough at one end passable through said chain bore openings in said follower block and over the horns on said hammer, a chain release device having stop means with a larger dimension than said chain bore openings in said follower block so that said chain release device is not passable through said chain bore openings in said block at one end and being engagable with the elongated link at the other end of said chain, and chain lione actuated release means externally connected to remotely release the elongated link and said chain from said chain release device permitting the chain to pay out through said chain bore openings in said follower block and pass over the horns on said hammer whereby upon raising said hammer said hammer is separated from said follower block without human assistance in the striking area of the hammer and follower block.

2. The apparatus as claimed in claim 1 wherein said chain release device comprises a substantially closed housing having an opening through which the elongated link of said chain is received, detent means carried by said housing for securing said link to said housing, means securing said housing to the end of said chain remote from said elongated link, and remote pull means connected to actuate said detent means to release the elongated chain link from said housing to permit separation of said hammer and follow block.

3. The apparatus of claim 2 wherein the detent means is a pin which passes through at least one wall of said housing and an opening in said elongated link and has a rope attaching loop on its exposed end for attachment of the pull means.

4. The apparatus of claim 1, said chain release device comprises a housing having a flat slotted opening through which the elongated link of said chain passes, one wall of said slotted opening having an opening, a detent pivotally mounted in said housing and having a projection passing through the opening in the wall of said slotted opening and the opening in said elongated link at the free end of said chain, spring means connected between said pivoted detent and said housing for maintaining the detent projection through the opening in said elongated link, and remote pull release means connected to said pivotally mounted detent on the side of said pivot remote from said projection so that upon pulling a rope connected to said release means causes the projection to be removed from engagement with said elongated link to free the chain from the hammer.

5. The method of separating a hammer from a follow block in a pile driving leads without requiring a human to ride the leads and break the chain connection between said hammer and follow block comprising the steps of:

(a) establishing a chain lifting, connection between a hammer having horns and chain hole bores in said follow block, (b) establishing a pile raising connection between the follow block and a pile so that upon raising the leads the pile will be picked up by the follow block and hammer to position the piling within the leads at the location for driving the pile, (c) lowering the leads, hammer and follow block until the piling enters the earth and the piling is then supporting the follow block and hammer and all hammer and pile weight is off the chain, and (d) then remotely releasing the chain connection between said hammer and follow block from the ground so that upon raising of the hammer the chain will pay out through the follow block and over the hammer horns to permit the follow block to ride the pile and the hammer to be raised and dropped within the leads independently of the follow block.

6. The method of driving a piling employing a pile driving leads having a hammer and follow block reciprocably mounted therein comprising the steps of:

(a) establishing a remote rope ground actuated quick release chain lifting connection between the hammer and follow block, (b) establishing a pile raising connection between the follow block and a pile so that upon raising the leads the pile will be picked up by the follow block and hammer for positioning the piling within said leads above the location at which the pile is to be driven, (c) lowering the leads, hammer, follow block and piling until the piling enters the earth and the earth is supporting the piling, follow block, hammer and leads and all hammer, follow block and pile weight is off the chain connection between the hammer and follow block chain connection, (d) then releasing the chain connection between the hammer and follow block so that upon raising the hammer relative to the follow block the chain will pay out through the follow block and over the hammer horns to permit the follow block to ride the pile and the hammer to be raised and dropped within the leads independently of the follow block for driving the piling.

* * * * *